United States Patent [19]

Helgesen

[11] 4,243,873

[45] Jan. 6, 1981

[54] COMPATIBLE CERAMIC ELECTRIC HEATER FOR FOOD HANDLING VESSELS

[75] Inventor: Paul E. Helgesen, Seven Valleys, Pa.

[73] Assignee: Susquehanna Broadcasting Co., York, Pa.

[21] Appl. No.: 7,421

[22] Filed: Jan. 29, 1979

[51] Int. Cl.[3] ..... H05B 3/68

[52] U.S. Cl. ..... 219/386; 219/432; 219/436; 219/463

[58] Field of Search ..... 219/386, 387, 340, 351, 219/432, 357, 436, 447, 455, 458, 459, 460–464, 467, 443, 473, 444

[56] References Cited

U.S. PATENT DOCUMENTS

| | | | |
|---|---|---|---|
| 1,045,320 | 11/1912 | Parkhurst | 219/458 |
| 1,533,175 | 4/1925 | Fahrenwald | 219/460 |
| 1,831,110 | 11/1931 | Heise | 219/463 |
| 1,990,640 | 2/1935 | Doherty . | |
| 2,253,927 | 8/1941 | Butler et al. . | |
| 2,978,564 | 4/1961 | Blanding et al. | 219/460 |
| 3,395,266 | 7/1968 | Price . | |
| 3,725,641 | 4/1973 | Tilp . | |
| 3,876,861 | 4/1975 | Wightman et al. | 219/463 |

FOREIGN PATENT DOCUMENTS

| | | | |
|---|---|---|---|
| 973144 | 2/1951 | France | 219/464 |
| 195969 | 4/1923 | United Kingdom | 219/464 |

*Primary Examiner*—Gerald P. Tolin
*Assistant Examiner*—Bernard Roskoski
*Attorney, Agent, or Firm*—C. Hercus Just

[57] ABSTRACT

This invention pertains to an electrical heating device for heating ceramic food preparation and serving vessels and comprises a ceramic base compatible aesthetically with a set of such serving vessels and having a central opening in the top surface associated with an annular seat which receives and supports an electrical resistance heating unit, the unit being complementary in size and shape to the opening and seat and supported therein solely by gravity for ready removal to permit the base to be cleansed while the heating unit is removed therefrom.

2 Claims, 3 Drawing Figures

COMPATIBLE CERAMIC ELECTRIC HEATER FOR FOOD HANDLING VESSELS

BACKGROUND OF THE INVENTION

Electrical resistance heating units for various types of food-warming and heating or cooking have been known for many years. Usually these are referred to as electric hot plates. Typical examples of this type of device are illustrated respectively in the following U.S. Patents:

No. 1,990,640 Doherty Feb. 12, 1935
No. 2,253,927 Butler et al Aug. 26, 1941
No. 3,395,266 Price July 30, 1968
No. 3,725,641 Tilp Apr. 3, 1973
No. 3,876,861 Wightman et al Apr. 8, 1975

As far as is known, especially as illustrated by the foregoing patents, electrical heating devices of this type include heating units which are permanently affixed to the bases which support them, whereby unless the heating unit is appropriate sealed against the ingress of water or other cleaning fluid, it normally is not possible to cleanse the base simply by immersing the same in dishwater or the like, or mechanical dish washing equipment, due to the fact that the average type of electrical heating unit would be impaired by such cleansing operation. The present invention overcomes this difficulty by a structure which is described in the following specification and illustrated in the drawing comprising a part thereof.

SUMMARY OF THE INVENTION

It is the principal object of the present invention to provide an electrical heating device adapted particularly for heating ceramic food preparation and serving vessels of a compatible set thereof, such as by including the same type and color of glaze or other ornamental features, the heating device comprising a ceramic base similarly colored and glazed or otherwise ornamented so as to be compatible with said set of food preparation and serving vessels, and in particular, the ceramic base is readily separable from an electric resistance heating unit which is supported by gravity in a seat in the top of said ceramic base, the engagement of the heating unit with said seat being solely by gravity or an appropriate connecting means which may be disconnected without requiring the use of tools.

It is another object of the invention to arrange said seat at least slightly below the upper surface of the top of said base and the periphery of said electrical resistance unit engaging said seat for support thereby.

A still further object of the invention is to provide said warming device with a peripheral flange on said electrical heat resistance unit which extends radially outward from the upper surface of said unit, said flange comprising the sole means of the resistance unit which engages said seat.

Still another object of the invention is to provide a circular ceramic base in which the opening therein is centrally of the top and the upper surface of said top being provided with a plurality of short annular ridges which are concentric with each other and said central opening, and the innermost ridge comprising a wall of said seat and said plurality of ridges further comprising positioning means respectively for several different diameters of food handling vessels to minimize the possibility of accidentally sliding said vessels laterally with respect to the top of said base.

Details of the foregoing objects and of the invention are set forth in the following specification and illustrated in the accompanying drawing comprising a part thereof.

DETAILED DESCRIPTION OF THE PREFERRED EMBODIMENT

Figure 1:
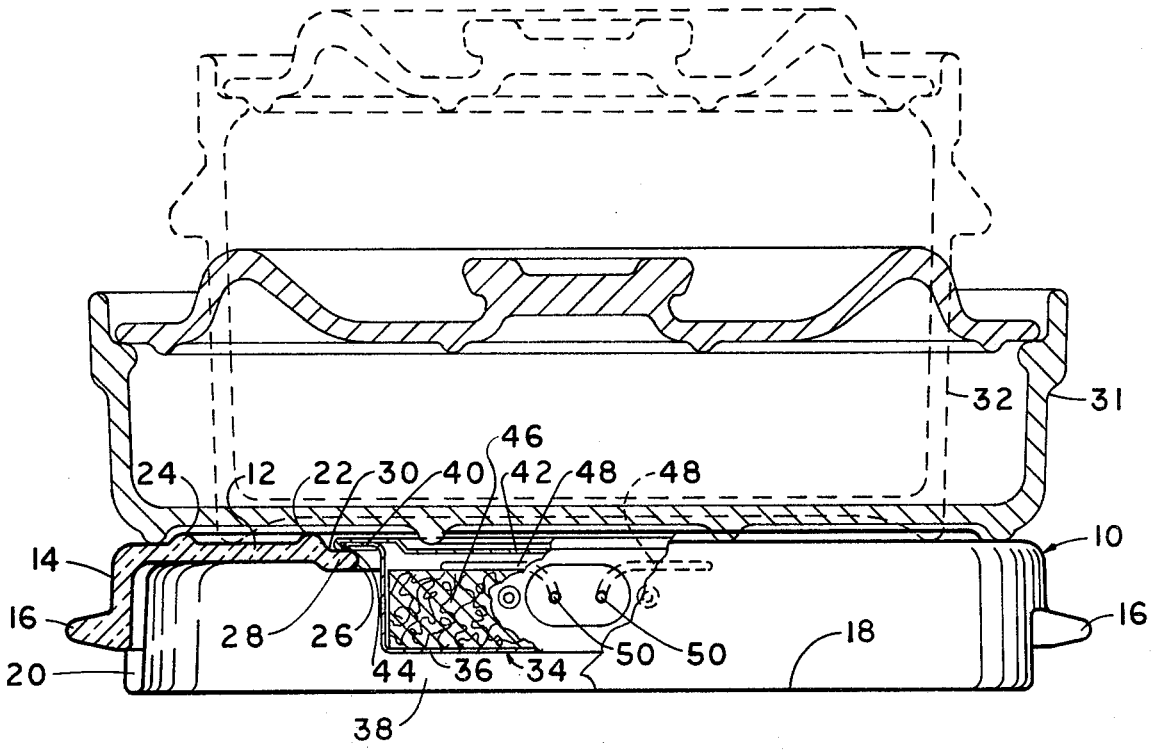
FIG. 1 is a top plan view of the preferred embodiment of warming device embodying the principles of the present invention, a portion of said device being broken away fragmentarily to disclose details of the heating unit for said device.

To describe the present invention in its preferred category, it primarily comprises an additional element of a compatible set of ceramic articles used in the preparation and serving of food, particularly at the so-called table side, or actually on the table. The principal function of the electrical heating device is to either initially warm or continue maintaining the temperature of warm food contained in certain of said serving vessels, such as casseroles, carafes for beverages, or other types of suitable serving dishes incident to the meal being served and consumed. In order to render the heating device compatible with the preferably matching preparation and serving vessels, it is formed of the same material, i.e., ceramic, and is suitably decorated, such as by having the same shade or hue of glaze applied thereto as is on the preparation and serving vessels. More importantly, however, and herein lies one of the principal attributes of the present invention, the electrical heating unit of the device is readily removable from the ceramic and aesthetically compatible base in order that said base may be cleansed at the same time and/or in the same manner as the ceramic food preparation and serving vessels without the necessity of immersing the electrical resistance heating unit with the possible damage thereto. To accomplish this, the heating unit is supported by a suitable flange, details of which are described hereinafter, formed on the ceramic base and defining a central opening therein, the support of the heating unit by said base being solely by gravity. Details of all aspects of the present invention are as follows.

The ceramic base 10 is suitably molded from appropriate ceramic material comparable to that from which the coordinated and compatible food preparation and serving vessels are formed, said base having a top 12 and depending sidewalls 14. Appropriate handles 16 are formed either integrally or detachably connected to the sidewalls 14 of the base 10. The lower edge 18 of the sidewalls 14 also are provided with one or more recesses or notches 20 for purposes to be described.

In the preferred embodiment of the invention, the base 10 preferably is circular, particularly to be compatible in shape with the vast majority of food preparation and serving vessels now available on the market; however, said shape is not considered to be restrictive but is merely illustrative. Further, the top 12 preferably is provided with a plurality of short annular ridges 22 and 24, the upper surfaces of which are preferably around and the same are coaxial with a central opening 26. The opening 26 is defined by a horizontal flange 28 which preferably is at a level slightly below that of the upper surface of top 12 and said flange cooperates with the inner circular ridge 22 to form a seat 30, the horizontal supporting surface of which is below the upper surface of the inner ridge 22, for purposes to be described.

Figure 2:
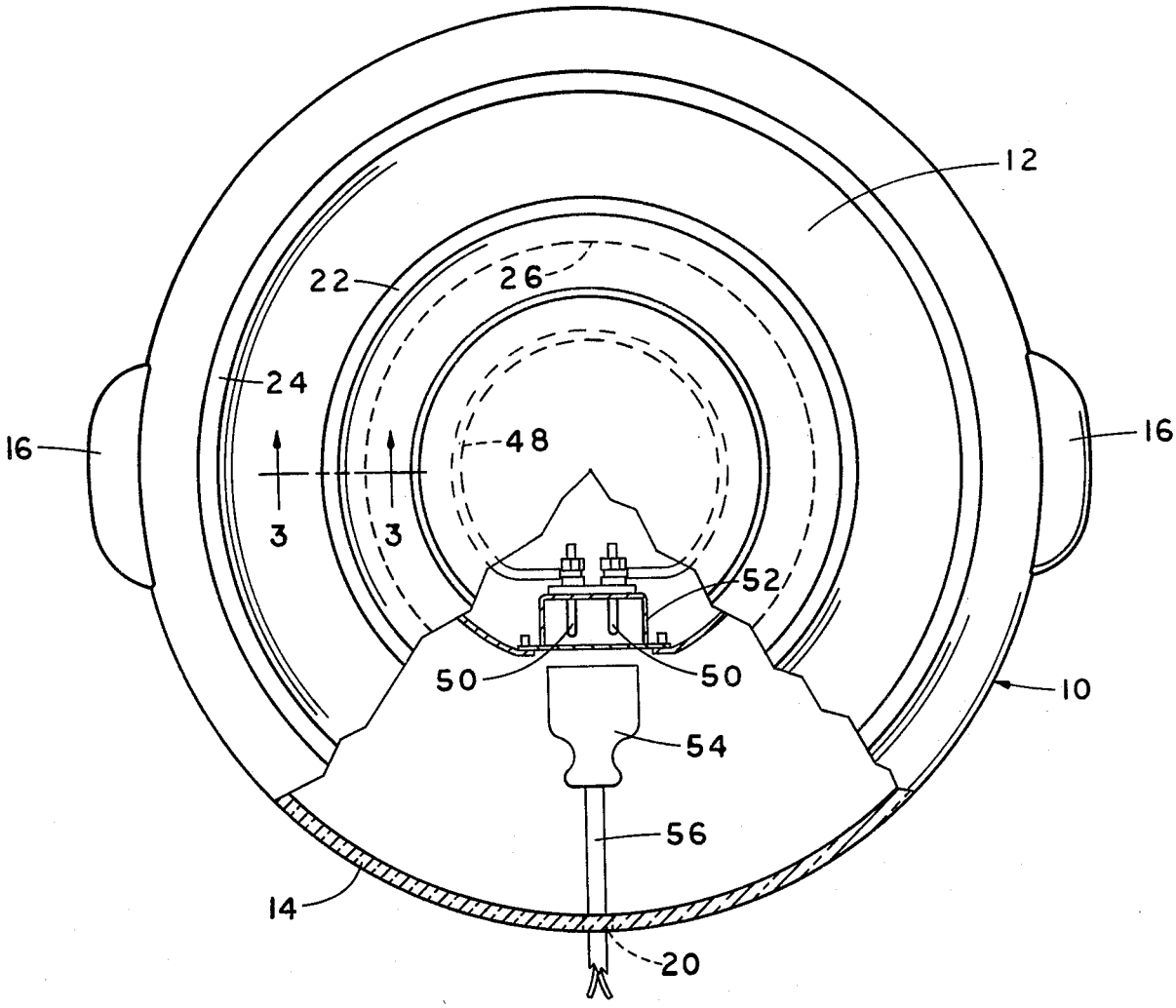
FIG. 2 is a side elevation of the warming device shown in FIG. 1 and also being partially broken away vertically to disclose details of the base and electrical resistance heating unit, especially revealing the gravity support of said resistance unit by a seat in the top of said base.

The primary function of the coaxial ridges 22 and 24 is to respectively comprise positioning means for several different sizes of food preparation and serving vessels, such as a relatively large casserole 31, shown in full lines in FIG. 2, or a smaller diameter vessel 32, shown in phantom in FIG. 2, for association with the inner ridge 22, while the outer ridge 24 is associated with a larger diameter of vessel. If desired, the outer ridge 24 may be slightly higher than the ridge 22 in order to be engaged by the larger diameter vessel 31. The vessel 32 may comprise, for example, a carafe or any other appropriate smaller size of food or beverage preparation and serving vessel.

As stated above, in the preferred use of the base 10, it is intended to serve essentially as a warming device for food preparation and serving vessels, either upon a table top or adjacent a table, regardless of whether the table is spread with a tablecloth or otherwise. To accomplish this intended use, the base 10 is provided with an electrical resistance heating unit 34 which, in the preferred embodiment thereof, comprises a metal shell 36 of a predetermined depth of sidewall, but which sidewall is of a shorter dimension than that of the sidewall 14 of the base 10 in order to provide a predetermined space 38 between the bottom of the shell 36 and the lower edge 18 of the base 10. The upper edge of the sidewalls of the shell 36 terminate in a horizontal flange 40, which has a limited radial dimension and the diameter thereof is slightly less than that of the seat 30. Also, the heating element 34 is provided with a metal top 42, which is coextensive in diameter and area with the shell 36 and flange 40, and the peripheral portion 44 of top 42 is rolled under the flange 40 of the metal shell 36 as best shown in FIG. 3 for purposes of securing the top 42 to the shell 36.

Referring to FIG. 2, it will be seen that the lower portion of the cup-shaped shell 36 contains a highly efficient mass 46 of suitable heat insulation of a type which is approved by the Underwriter' Laboratories, the insulation 46 preferably extending upwardly in the shell 36 to a position closely beneath the top 42 of the heating unit 34 but providing a space within which an electrical resistance heating element 48 is positioned, one exemplary shape of which is shown in plan view in FIG. 1. The opposite ends of said element are connected to electrical contacts 50 which are supported by a suitable bracket 52, the contacts 50 being suitably electrically insulated from each other by conventional means associated with the bracket 52. The contacts 50 are of the prong type, for example, adapted to be frictionally engaged by an electrical conduit plug 54 which is connected to one end of the conduit or "electric cord" 56, the other end of which is appropriately connected to a source of electric current, at a rate of 35–45 watts, for example, which is sufficient to provide adequate warming in accordance with the preferred intent of the invention.

By way of example, and without limitation thereto, the heating element 48 is approximately six inches in diameter, and the central opening 26 is complementary to such dimension for purposes of receiving the metal shell 36 of the unit 34. Also, it has been found practical to make the base 10 approximately eleven inches in diameter and substantially two inches high, but such dimensions are not to be considered restrictive and are only exemplary.

Figure 3:
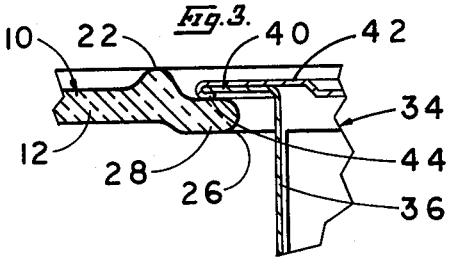
FIG. 3 is an enlarged fragmentary detail of the structure as seen on the line 3—3 of FIG. 1.

From FIGS. 2 and 3, it will be seen that the upper surface of the composite flange of the electric resistance unit 34 is at least no higher than the upper surface of the inner ridge 22 in order than when a food or beverage preparation or serving vessel is placed upon the base 10, it will be appropriately heated by the unit 34 and, if desired, the thickness of the composite flange may be such that the vessel 31 or 32 may rest directly upon the top of the heating unit 34. In any event, especially for purposes of warming food, as distinguished from cooking it, the heat supplied by the resistance heating element 48 is calculated so that preferably, under normal intended circumstances, the heat generated thereby will not exceed a predetermined temperature, such as produced by the foregoing wattage.

Also, the conduit or "cord" 56 may extend from the plug 54 through one of the recesses or notches 20 in the lower edge 18 of the base 10 for connection of the opposite end of said cord with a suitable electric outlet.

From the foregoing description, especially from the illustrations in FIGS. 2 and 3, it will be seen that the electric heating unit 34 rests solely by gravity upon the seat 30. Accordingly, it may readily be removed by disconnecting the plug 54 from the contact 50 and then the ceramic base 10 may be immersed in a dishpan, dish washing machine, or otherwise for suitable cleansing. By such arrangement, it is not necessary to subject the heating unit 34 to wetting and, furthermore, because of the adequate space 38 between the lower edge of the base 10 and the bottom of the unit 34, as well as the efficiency of the insulation material 46, there is no harm imposed upon a supporting surface upon which the base 10 rests for support, regardless of whether the same is fabric or a solid material, such as wood or otherwise. The base and the heating unit associated therewith is completely capable of being utilized at a dining table or upon a serving table adjacent a dining table, without harm to either.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An electrical heating device for use in heating an article of a compatible set of ceramic food preparation and serving vessels of various shapes and kinds, said heating device comprising in combination, a unitary ceramic base having a horizontal top and depending sides provided with an aesthetic finish similar to and compatible with ceramic vessels of a compatible set thereof, an opening in said top of smaller diameter than said top and including a peripheral seat spaced below the upper surface of said top and said top also having a plurality of radially spaced short annular ridges having rounded surfaces and being concentric with said opening and the innermost ridge comprising a wall of said seat, an electrical resistance heating unit connectable to a source of electric current to cause the same to generate heat, said unit having a cup-shaped metallic shell substantially complementary in size to said opening and seat in said top of said base and also having the upper end of said shell terminating in a laterally extending peripheral flange engaging and resting upon said seat in said base by gravity to support said unit thereby, and said cup-shaped shell also being closed by a flat metal top secured to said flange and having an upper surface no higher than said innermost ridge of said ceramic base and having a heating element therein adjacent the inner surface of said metal top and disposed on top of insulation in said shell to afford maximum efficiency of heating and insulation, said unit being readily separable from said base without the use of tools by simply lifting it from said seat in said base to permit cleansing of said base when said unit is removed therefrom.

2. The warming device according to claim 1 in which said sides of said ceramic base depend cylindrically a predetermined distance below the lower surface of said heating unit and the lower edge of said sides of said base having at least one recess therein through which an electric cord can extend from said heating unit for connection to an exterior source of electric current.

* * * * *